United States Patent [19]

Blatt

[11] 4,122,949

[45] Oct. 31, 1978

[54] ROLL HOLDING CARTON

[75] Inventor: David H. Blatt, Elkins Park, Pa.

[73] Assignee: Franklin Container Corporation, Philadelphia, Pa.

[21] Appl. No.: 830,034

[22] Filed: Sep. 2, 1977

[51] Int. Cl.[2] ..... B65D 85/02; B65D 85/67

[52] U.S. Cl. ..... 206/303; 206/394; 206/397; 206/408; 220/409

[58] Field of Search ..... 206/303, 389, 391, 394–397, 206/408, 493; 229/14 BE, 15, 23 R

[56] References Cited

U.S. PATENT DOCUMENTS

| | | | |
|---|---|---|---|
| 2,424,553 | 7/1947 | Conti | 206/408 |
| 2,860,773 | 11/1958 | Zackheim | 206/394 |
| 2,943,732 | 7/1960 | Kovaleski et al. | 206/303 X |
| 3,280,987 | 10/1966 | Steinbock | 206/303 X |
| 3,680,810 | 8/1972 | Jarmalow | 206/408 X |

FOREIGN PATENT DOCUMENTS

| | | | |
|---|---|---|---|
| 610,733 | 12/1960 | Canada | 206/396 |
| 30,243 | 1/1956 | Fed. Rep. of Germany | 206/394 |

*Primary Examiner*—Steven E. Lipman

*Attorney, Agent, or Firm*—Leon Edelson; Walter B. Udell

[57] ABSTRACT

A combination shipping and storage containers for rolls of sheet material having hollow centers, the container having an interiorly disposed spindle like post extending vertically between opposite ends thereof upon which the rolls are held against radial shifting movement. The container is provided at each of its opposite ends with closure panels which are inwardly foldable from an open position thereof into flatwise superimposed closed positions to embrace therebetween out-turned flaps provided at each end of the post to hold the same in fixedly secured position within the closed container. The container is especially designed for use with rolls of low friction sheet material, such as mylar, to prevent telescoping of the rolled up convolutions relatively to one another and to this end each of the rolls "spindled" on the post is individually provided with an underlying centrally apertured flat support member so that said member and the roll supported thereon as a unit may be placed on and removed from the internal post of the container.

10 Claims, 8 Drawing Figures

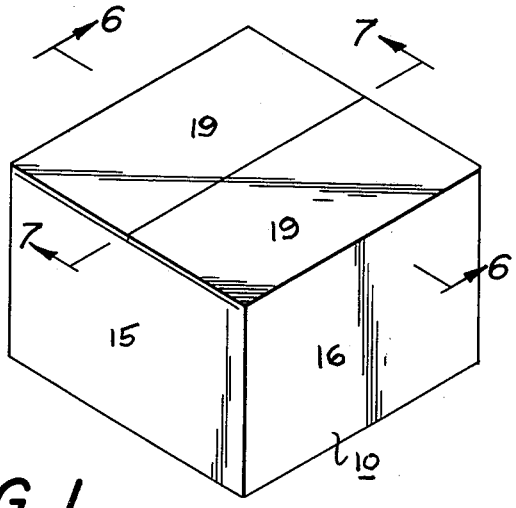
FIG. 1
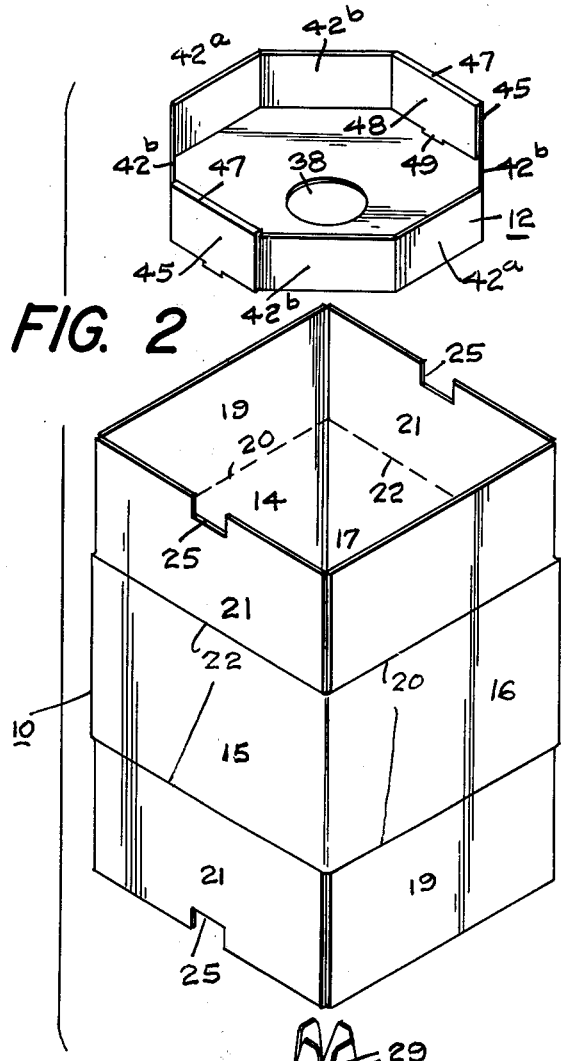
FIG. 2
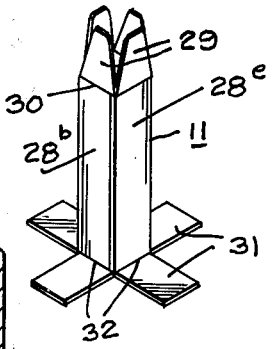
FIG. 6
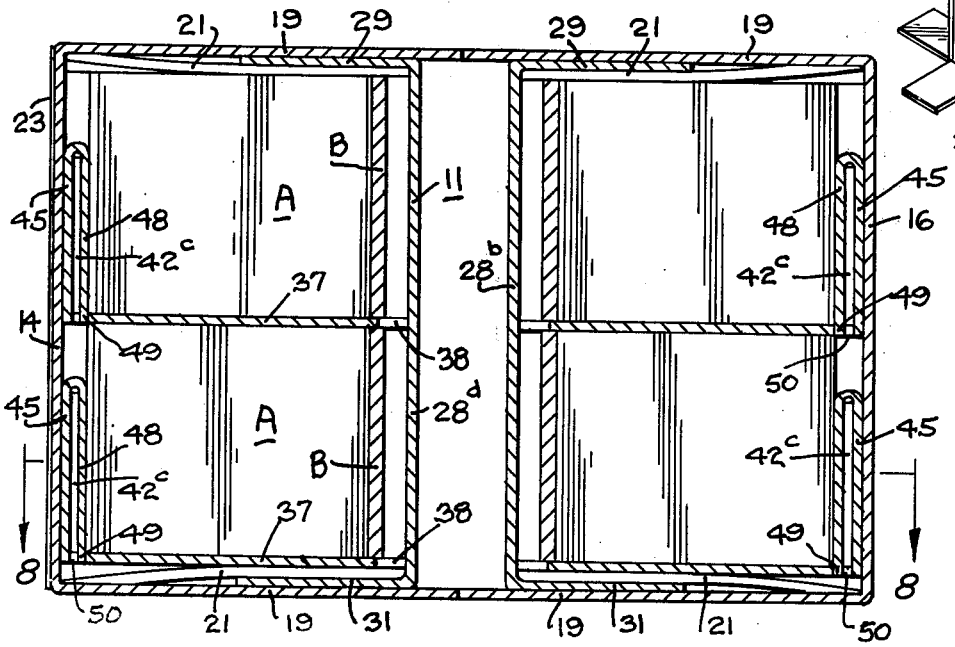

FIG. 7
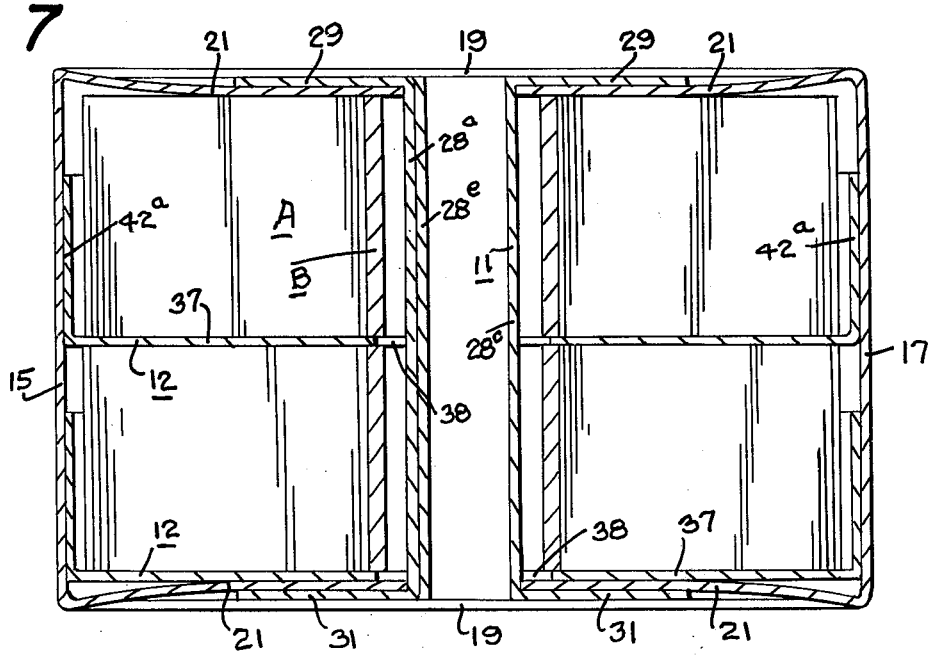
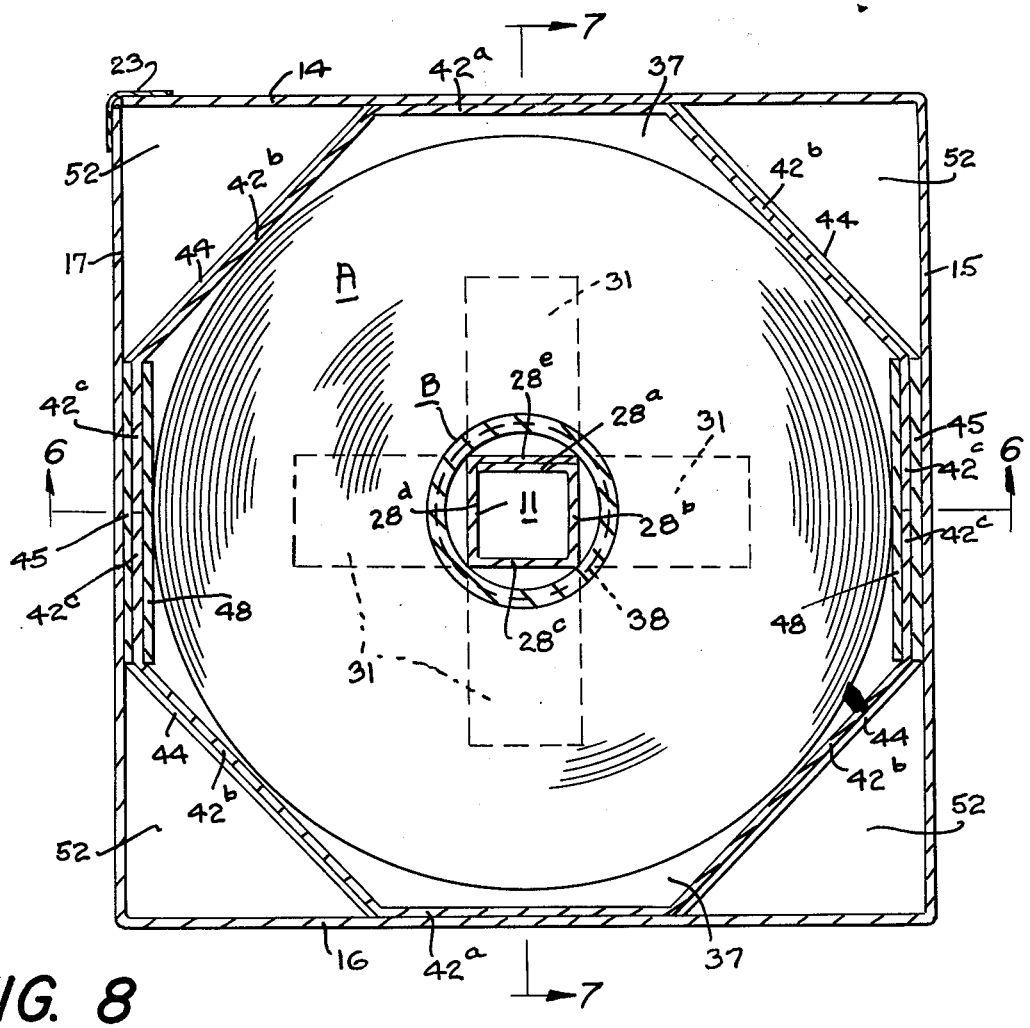
FIG. 8

ROLL HOLDING CARTON

This invention relates generally to shipping and storage containers and more particularly to an improved construction of a container designed for the reception and storage of rolls of sheet material which require protection against any axial displacement, i.e., telescoping, of the convolutions of the rolled material relatively to one another.

Among the most important requirements in the handling of rolls of sheet material is the necessity of insuring that the opposite edges of the rolled-up material are respectively disposed and maintained at all times in flat parallel planes orthogonal to the axis of the roll. This poses an especially difficult problem in the case of rolls of plastic films, such as mylar and the like, which have a low coefficient of friction between superimposed layers thereof and which, after being initially formed into a roll of a given width are then required to be slit into rolls of narrower width. Unless the stock roll, which perhaps may be 4 or more inches in width, is held against axial telescoping of its convolutions, it becomes virtually impossible to slit the same into narrower rolls of uniform width throughout the full lengths thereof. Further, once any telescoping of the relatively wide stock roll occurs, it is difficult, if not impossible, to restore it to its necessary condition in order that it may be entirely used to produce therefrom the desired rolls of uniformly narrower width.

Such stock rolls of plastic film and the like are of considerable bulk and quite heavy and since they are normally handled by lifting and carrying the same while supported at diametrically opposite sides thereof with their central axes extending vertically, the tendency for the roll convolutions to telescope is quite pronounced and all too frequently occurs with the result that substantial portions of the roll, if not the entire roll, is rendered unusable and must be put aside for salvage.

Having in mind the foregoing, it is among the objects of this invention to provide a means whereby the stock roll of the low friction material, such as mylar or other such plastic film and the like, is held against the aforementioned undesired telescoping thereof, not only as it is transferred from the apparatus which initially produces the roll to the apparatus for slitting the same into rolls of narrower width, but also during the storage and shipment of the same.

A further object of the present invention is to provide a container for one or more of the above mentioned rolls of low friction material, which serves not only to protect the rolls against damage during shipment thereof but also as a depository for safely storing the rolls against the undesired telescoping thereof.

A still further object of the present invention is to provide a container which is of such design and construction as to facilitate ready and easy placement of the stock rolls in and removal thereof from the container without risk of any telescoping thereof and which serves to fully and completely protect the rolls against the likelihood of any such telescoping thereof during transport and storage thereof.

Still another and important object is to provide a shipping and storage container for rolls of plastic film and like material having low coefficients of friction which includes one or more trays each designed to receive and support therein against untoward axial distortion a roll of said material and which roll-loaded trays are adapted to be "spindled" in axially stacked relation onto a post centrally positioned in the container.

A further object is to provide a container designed for the purposes aforesaid which is simple and inexpensive to construct, which is strong and durable in use and wherein all of its components, including the aforesaid roll-receiving trays and the center post for holding the trays centered in the container are all fabricated from blanks of corrugated paper board or like sheet material individually cut, scored and folded to produce the several components of the container.

Other objects and advantages of the present invention will appear more fully hereinafter, it being understood that the invention consists in the combination, construction, location and relative arrangement of parts, as described more particularly in the following specification, as shown in the drawings and as finally pointed out in the appended claims.

In the accompanying drawings:

FIG. 1 is a perspective view showing in its fully closed condition the shipping and storage container constructed in accordance with and embodying the principles of the present invention;

FIG. 2 is an exploded view showing in perspective each of the several components which make up the container, namely, the outer box or enclosure expanded into its open condition, one of the trays for supporting a roll of the material in the container and the center post for locating the roll-supporting tray or trays centered within the container;

FIG. 6 is a vertical sectional view of the container assembly as taken along the line 6—6 of FIG. 1;

FIG. 7 is a vertical sectional view of the container assembly as taken along the line 7—7 of FIGS. 1 and 8; and FIG. 8 is a horizontal sectional view of the container assembly as taken along the line 8—8 of FIG. 6.

Referring now more particularly to the drawings, it will be observed that the shipping and storage container of the present invention essentially comprises an outer enclosure or container in the form of a box 10 having top and bottom closure flaps, a vertically extending center post 11 which is removably secured in position centrally within the box, and one or more centrally apertured flat-bottomed trays 12 adapted to be slipped flat-wise onto and off of the center post, the trays being each designed to receive therein a roll of plastic film or other sheet material rolled about a hollow core which fits snugly about the center post to prevent radial shifting of the roll relatively to said post while at the same time it is supported flat-wise within the tray itself against any telescoping of its convolutions.

All of the separate elements of the container, namely, the box 10, the center post 11 and the tray or trays 12 are each individually formed of suitably die cut, slitted and scored blanks of double-faced corrugated paper board which, as conventionally fabricated, consists of a corrugated core of paper sandwiched and glued between a pair of outer facings of paper. it will be understood, of course, that any other flat sheet material having the requisite strength and rigidity and which may be cut, slitted and folded as described to form the several individual components of the container may be employed in lieu of the aforementioned corrugated paper board stock.

Figure 3:
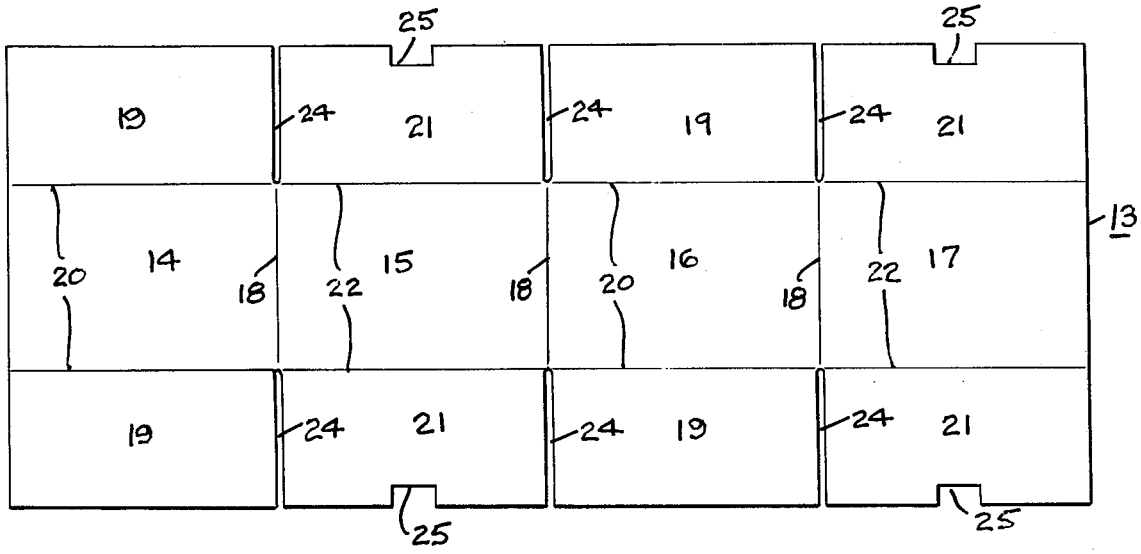
FIG. 3 is a plan view of the blank from which the outer enclosure box is formed.

The outer enclosure or box 10 is formed of the single blank 13 shown in FIG. 3 which is scored and slit to provide a box of polygonal form in horizontal cross-section, preferably of square cross-section, having the four side walls respectively formed of the panels 14, 15, 16 and 17 of the blank 13, which latter is scored along the vertically extending parallel lines 18 to permit the side walls panels to be relatively bent into their sidewall-forming positions.

Each of the side wall-forming-panels 14 and 16 of the blank 13 is provided with a pair of oppositely projecting top and bottom closure flaps 19—19 which are respectively bendable along the score lines 20—20, while each of the side wall-forming panels 15 and 17 are similarly provided with top and bottom closure flaps 21—21 respectively bendable along the score lines 22—22. In its expanded condition as shown in FIGS. 2, 6 and 7, the meeting free edges of the side wall panels 14 and 17 of the box are secured together by a corner tape 23 or otherwise as desired.

The top and bottom closure flaps 19—19 and 21—21 along each side of the blank 13 are rendered independently bendable about their respectively associated score lines 20 and 22 by slits 24 suitably provided in the blank as shown in FIG. 3.

The top and bottom closure flaps 21—21 differ from the flaps 19—19 only in the respect that each of said flaps 21—21 is provided in its outer edges centrally between its slit opposite side edges with a cut out notch 25, for a special purpose to be hereinafter described. It is to be noted that when the box 10 is formed and set into its properly expanded and fully closed condition shown in FIG. 1, the unfolded pair of the closure flaps 19—19, both at the top end of the box and at its bottom end, externally overlie the correspondingly infolded notched pair of the closure flaps 21—21.

Figure 5:
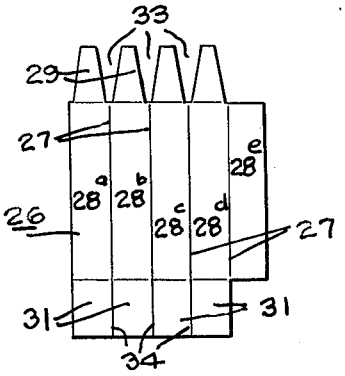
FIG. 5 is a plan view of the blank from which the center post of the container is formed.

The above mentioned center post 11 of the box 10 is formed out of the single blank 26 of FIG. 5, which blank is scored along the vertically extending parallel lines 27 to provide the relatively bendable panels $28^a$ to $28^e$ all of which except for the endmost panel $28^e$ are respectively provided at their upper ends with top flaps 29 foldable along the horizontally extending score lines 30 and at their lower ends with bottom flaps 31 foldable along the horizontally extending score lines 32. The top flaps 31 are slit apart, preferably by V-shaped cuts 33, to provide the same with tapered side edges as shown, while the bottom flaps are also slit apart along the lines 34. These top and bottom flaps are all individually bendable outwardly of and into substantially right-angular relation to the panels $28^a$ to $28^d$ from which they respectively extend.

The center post blank 26 is set up into its form shown in FIG. 2 by simply bending the panels $28^a$ to $28^d$ into a four-sided tubular construction with the endmost panel $28^e$ thereof externally overlapping the panel $28^a$. Thereafter, with the post held in its tubular form, the top flaps 29 and the bottom flaps 31 may be outwardly bent into substantially coplanar relation as and for the purposes hereinafter described. However, it will be noted at this point that the top flaps 29 of the formed center post, prior to their being outwardly bent into a coplanar relation, may be inwardly bent or pressed together so that they conjointly form an upwardly projecting tapered "lead-in" extension of the post to facilitate its reception of the roll-supporting tray 12 now to be described.

Figure 4:
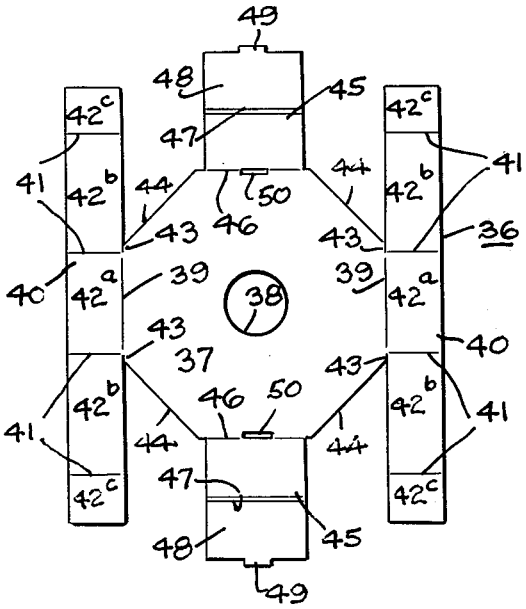
FIG. 4 is a plan view of the blank from which the roll-supporting tray is formed.

The tray 12 is also formed of a single blank 36 which is cut, slitted and scored as shown in FIG. 4 to provide a main central panel 37 of octagonal outline having a circular hole 38 centrally formed therein. Integrally joined to each of a first pair of diametrically opposed parallel sides of the central panel 37 of the blank along a scored juncture line 39 is an elongated panel 40 of an overall length slightly less than one half the full perimetral length of the central panel 37. These side panels 40 are each transversely scored along the parallel score lines 41 to provide a plurality of relatively bendable sections, to wit, a mid-section $42^a$ and sections $42^b$ and $42^c$ extending beyond each opposite end of the mid-section $42^a$, the endmost sections $42^c$—$42^c$ being each of a length approximately half that of one side of the central octagonal panel 37. Thus, when the side panels 40—40 are bent upright with respect to the central panel 37 about their fold lines 39—39 and the sections $42^b$ and $42^c$ are bent inwardly out of the parallel planes of the upright mid-sections $42^a$—$42^a$ of the side panels 40—40 into respective registry with the several edge portions of the central panel 37 which extend between the diametrically opposed parallel score lines 39—39, the central panel 37 constituting the bottom wall of the tray 12 is provided with an upstanding side wall extending about its entire perimentral extent. It will be noted that the blank 36 is inwardly slit at each of the corners of the central panel 37 which adjoin the side flaps 40—40, as at 43, so that the mid-sections $42^a$ of said flaps are each of a length slightly less than that of the edge of the central panel which is coincident with the fold line 39 and the side flap sections $42^b$ are of lengths slightly greater than those of the freely disposed side edges 44 of the octagonal central panel 37 of the blank 36. Thus, when the side panels 40—40 are bent upwardly at right angles to the plane of the central panel 37 and the sections $42^b$—$42^c$ thereof are relatively inturned about their score lines 41 to form the upstanding perimentral wall of the tray, the sections $42^b$ are disposed just within the perimetral outline of the panel 37 and so rest edgewise on the top surface of the panel itself.

In the tray 12 formed as just described, it will be noted that when the side-wall-forming panels 40—40 are upturned about the score lines 39—39 and the panel sections $42^b$ and $42^c$ are angularly related as shown in FIG. 2, the corresponding end-most panel sections $42^c$ are disposed in a common vertical plane with their free ends in substantially abutting relation so that each abutting pair of said sections $42^c$—$42^c$ conjointly form a segment of the side wall of the tray.

Each pair of the inturned substantially abutting wall sections $42^c$—$42^c$ are securely held together in their coplanar relation as above described at diametrically opposite sides of the tray by one of a pair of oppositely extending flaps 45—45 which respectively extend outwardly of the central panel 37 of the blank 36 from scored juncture lines 46—46, said flaps 45—45 being each foldable upon itself about a double-scored fold line 47 to provide an outer section 48 adapted to be inwardly folded over and about the top edges of each abutting pair of wall-forming sections $42^c$—$42^c$ to thereby embrace the latter between the doubled-over sections of each flap 45. The doubled-over outer section 48 of each flap 45 is provided in its free edge with a locking tab 49 which is adapted to be pressed into a registering notch 50 formed in the central panel 37 of the blank just inside of the juncture line 46, to thereby lock each of the paired wall sections 42$^c$—42$^c$ in secured position within the embrace of folded flap 45 as shown in FIGS. 2 and 6.

It will thus be seen that when the flaps 40—40 are upturned into their tray side wall-formed position as shown in FIG. 8, all of the angularly related sections of the tray side wall either rest upon the top surface of the bottom wall of the tray or are integrally secured thereto, in consequence of which the bottom wall of the tray is effectively restrained against any such planar distortion or flexing thereof as would of itself possibly cause or allow axial displacement or telescoping of the outer convolutions of the rolled-up material nested in the tray when the latter in its loaded condition is upwardly lifted by grasping the underside of the tray bottom wall at diametrically opposite sides thereof.

In use of the container assembly of the present invention, the first step is to centrally position and secure in the bottom of the box 10 the center post 11 erected into its tubular form as hereinbefore described and as best shown in FIG. 2, in which form the bottom flaps 31 thereof project radially outwardly from the vertical axis of the post and are disposed in a common plane orthogonal to that axis.

These coplanar bottom flaps 31 of the center post are sandwiched between the infolded pair of the bottom closure flaps 19—19 and the infolded pair of the bottom closure flaps 21—21 in accordance with the following preferred procedure:

The bottom closure flaps 19—19 of the box are initially inturned into their coplanar bottom closing positions and taped or otherwise joined together to form a closed flat bottom for the box. Thereupon, with the bottom closure flaps 21—21 raised upwardly above said initially closed flat bottom of the box, the center post 11 is centrally positioned in the box with its outwardly extending bottom flaps 31 disposed flatwise against said flat bottom of the box. With the center post 11 so vertically positioned in the box between the raised bottom flaps 21—21 thereof, the latter are then moved downwardly into their coplanar bottom closing positions at the same time that the notches 25 in their free edges respectively embrace opposite upwardly extending side portions of the center post. The notches 25—25 thus conjointly form an opening which conforms to the horizontal cross-section shape of the center post and substantially embraces it and so holds it firmly centered within the box. Thus, with the outwardly extended flaps 31 of the post sandwiched between the two flattened-out pairs of the box bottom closure flaps 19—19 and 21—21 the post 11 is fixedly secured in the fully closed bottom of the box against any axial or radial displacement. The box 10, with only its top end open as shown in FIG. 2, is then ready to receive one or more of the trays 12, each loaded with a roll A of the plastic film or the like, as shown in FIGS. 6, 7 and 8.

The box 10 may be of any desired vertical dimension to accommodate one or more of the tray-supported rolls A stacked vertically therein one above the other. FIGS. 6 and 7 show the box as designed for two such vertically stacked tray-supported rolls A, it be noted that the flat bottom of the upper tray rests flat-wise directly upon the flat upper face of the bottom roll A and that both rolls are held against radial displacement within their respective supporting trays 12 with their center cores B in axial alinement by the box center post 11 which projects axially through the cores of the rolls A. It will be noted also that the internal diameters of the roll cores B are such as to enable the latter to be easily slipped snugly onto the center post without any substantial side play. In order to insure against any possible undesired downward displacement of the roll core B through the center hole of the tray, the diameter of the tray center hole 38 should be so sufficiently smaller than the external diameter of the roll core that when the roll-loaded tray is slipped onto the center post at least the outer marginal portion of the roll core will rest upon and be supported by the portion of the tray bottom wall which marginally encircles its center hole 38, as is shown in FIGS. 6, 7 and 8.

Preferably, the diameter of the tray center hole 38 is just enough greater than the maximum outside cross-sectional dimension of the center post 12 as to allow the tray easily to be slipped onto and off of the center post without any frictional restraint as might result from a too tight fit of the tray about the center post, it being important to observe in this connection that the roll A nested in the tray, which on occasion may not completely fill the tray, is held against lateral shifting in the container primarily by the snug fit of its center core about the relatively fixed-in-position center post 11 of the container.

After the box 10 is filled with its full complement of the roll-loaded trays with each such loaded tray "spindled" upon the vertically extending center post 11 while the top flaps thereof are in their upwardly extending open condition as shown in FIG. 2, the top of the box may be closed by first infolding the notched closure flaps 21—21 and thereafter the closure flaps 19—19 into their respective coplanar flat conditions as shown in FIGS. 6 and 7 to sandwich therebetween the top flaps 29 of the center post and thereby fixedly secure the upper end of the post in the closed top of the box. This procedure is the reverse of that above described for securing the bottom end of the post within the sealed bottom of the box in that for sealing the box closed the notched pair of its top flaps 21—21 must first be infolded so that their notches 25—25 conjointly embrace the post just below the fold lines 29 of the post top flaps 29 prior to turning the latter outwardly into coplanar relation for disposition flatwise against the top surfaces of the inturned box flaps 21—21. Thereupon the pair of top closure flaps 19—19 may be infolded and sealed closed by any suitable means and with the top and bottom ends of the box being so closed as described both the bottom and top ends of the post 11 will be securely held against any possibility of lateral displacement within the box.

In its preferred construction, the box 10 is of a square configuration in horizontal cross-section to snugly and non-rotationally accommodate therein the octagonally shaped tray as shown in FIG. 8. This combination of the box and tray provides in each corner of the box an open area 52 of sufficient extent to permit a person to reach beneath and grasp the bottom of the loaded tray at diametrically opposite sides thereof to lift the same upwardly along the center post and out of the opened top of the box.

It will of course be appreciated that the trays 12 may be formed other than as shown and described herein as, for example, by molding or pressing them out of any suitable material to provide the same with a substantially inflexible flat centrally apertured bottom wall having an upstanding side wall or rim of generally circular shape for holding in the tray a roll of the material being handled.

The tray 12 serves not only to support the stock roll of the plastic or other low friction material in its desired non-telescoped condition during its placement in and removal from the box 10, but also serves ideally to support the roll against axial distortion of its convolutions during removal thereof from the apparatus upon which it is initially prepared and transfer thereof to and from the roll-slitting apparatus. For such use of the tray 12 it is simply applied axially against the suitably exposed flat end surface of the roll with its bottom wall disposed flat-wise against said surface, whereupon the loaded tray may then be grasped at diametrically opposite sides thereof for its safe removal from the roll-forming and/or roll-slitting apparatus and ultimate transfer to and placement in the container as above described. The side wall of the tray in which the roll of plastic film or the like is nested is preferably of a height less than the width or axial thickness of the roll itself so that when two or more of the roll-loaded trays are stacked in the container one above the other as shown in FIGS. 6 and 7, each of the loaded trays is bottomed upon a flat surface without resting upon the upper edge of the side wall of an underlying tray. Thus, as will be observed in FIGS. 6 and 7 showing a pair of axially stacked roll-loaded trays while the lowermost tray always has its bottom wall resting flatwise on the closed bottom of the container, the bottom wall of the next higher tray in the stack thereof rests upon the flat top surface of the underlying tray-supported roll and not upon the top edge of the wall of the underlying tray, in consequence of which the perimetral walls of the trays stacked one upon another in the container are free of having any such load imposed thereon as might tend to flex or otherwise distort the bottom wall of the tray out of its desired flat planar condition.

In view of the preceding statement, it will be appreciated that it is within the contemplation of the present invention to provide any suitable flat rim-less platen of sufficiently stiff or rigid material for supporting flatwise thereon a roll of material which, together with its said supporting platen, is slipped onto the center post 12. The only requirements for such platen is that it be of an outside diameter sufficient to fully support the entire roll and that its center hole is of a diameter which enables it to be freely slipped over the post but which yet prevents the core or the central portion of the roll from shifting axially down through the center hole when the underside of the platen is grasped to place the roll onto or remove it from the post.

It will be further understood that the present invention is susceptible of various other changes and modifications which may be made from time to time without departing from the general principles or real spirit thereof and that it is accordingly intended to claim the same broadly, as well as specifically, as indicated by the appended claims.

What is claimed as new and useful is:

1. In a shipping and storage container for rolls of sheet material of uniform width each convoluted about a hollow center core with the opposite side edges of the material respectively disposed flush with the opposite ends of said core in spaced parallel planes extending normal to the axis of the roll, in combination, a. an open-ended box structure having vertically extending right-angularly related side walls respectively provided with integral oppositely projecting hinged closure flaps, said closure flaps being inwardly folded relative to their associated side walls to provide at each of the opposite ends of said box structure overlapping closure flaps extending normal to the side walls of the box structure thereby providing the latter with double-ply top and bottom closure walls, b. a post member centrally disposed in said box structure and extending vertically between said closed top and bottom walls thereof and projecting through the hollow center core of said rolls, c. means interlocking each of the opposite ends of said post member in fixedly secured position between said overlapping pairs of box closure flaps, and d. at least one centrally apertured rigid flat-surfaced member underlying and flat-wise supporting the full circle of convolutions of one of said rolls of convoluted material and at least a portion of the center core thereof thereby maintaining intact the integrity of the roll against telescoping or other distortion of its convolutions, said rigid member being of an overall dimension large enough so as to prevent its radial displacement within said enclosure structure and being of an external perimetral outline sufficiently different from that of the enclosing side walls as to provide at least two diametrically opposed spaces between the perimetral edges of said rigid member and the enclosing side walls of said structure through which one may grasp the underside of said rigid member for axial movement of the roll carried by said rigid member onto or from said post.

2. In a shipping and storage container as defined in claim 1 wherein the central aperture of said rigid member is coaxial with the hollow center core of its supported roll whereby said member and the roll supported thereon as a unit may be axially slipped onto and off of said post.

3. In a shipping and storage container as defined in claim 1 wherein the walls of said roll core are substantially thicker than the thickness of said sheet material and wherein the central aperture of said rigid member is of a diameter greater than the internal diameter but less than the external diameter of said cores.

4. A shipping and storage container as defined in claim 1 wherein said rolls are axially stacked one above the other with each of said rolls resting flatwise upon the upper surface of an underlying rigid member.

5. A shipping and storage container as defined in claim 1 wherein said rigid member is provided with a substantially perimetrally continuous rim confining the roll of sheet material carried by said member against radial displacement relative to said rigid member.

6. A shipping and storage container as defined in claim 1 wherein all of the separable components thereof are respectively formed of corrugated paper board.

7. A shipping and storage container as defined in claim 1 wherein the innermost ply of said overlapping closure flaps at each closed end of the box structure is provided with an opening which perimetrally embraces the proximate ends of said post thereby holding the same positionally fixed against lateral displacement within the closed box structure.

8. A shipping and storage container as defined in claim 7 wherein said ends of the post are provided with outwardly extending elements disposed coplanarly in a common plane normal to the axis of said post and in flatwise engagement with the external surface of said innermost ply of said end closure flaps and wherein the outermost ply of each said overlapped end closure flaps is disposed flatwise over said coplanar post elements thereby fixedly embracing the latter between said closure flaps at each end of said box structure.

9. A shipping and storage container as defined in claim 1 wherein one end of said post proximate to one closed end of said box structure is provided with radially extending tabs disposed in a common plane extending normal to the vertical axis of said post, and wherein said tabs are commonly disposed flatwise between said overlapping closure to form with said overlapping flaps said one closed end wall.

10. A shipping and storage container as defined in claim 9 wherein said tabs at said one end of said post member each have outwardly converging side edges which may be inturned toward the post axis to present the side edges thereof in juxtaposed relation whereby to conjointly provide the post with a tapered end to facilitate axial placement of said roll or rolls of sheet material onto said post.

* * * * *